United States Patent [19]

Ohsumi

[11] Patent Number: 4,871,323

[45] Date of Patent: Oct. 3, 1989

[54] CONNECTOR WITH CONNECTION CHECK DEVICE

[75] Inventor: Hideki Ohsumi, Shizuoka, Japan

[73] Assignee: Yazaki Corporation, Tokyo, Japan

[21] Appl. No.: 275,197

[22] Filed: Nov. 23, 1988

[30] Foreign Application Priority Data

Nov. 24, 1987 [JP] Japan ..... 62-177478[U]

[51] Int. Cl.[4] ..... H01R 29/00

[52] U.S. Cl. ..... 439/188; 439/509; 439/513; 439/347

[58] Field of Search ..... 439/347, 488, 490, 491, 439/188, 509, 511–514, 507, 368

[56] References Cited

U.S. PATENT DOCUMENTS

| | | | |
|---|---|---|---|
| 2,704,840 | 3/1955 | Ward | 439/509 |
| 3,960,428 | 6/1976 | Naus et al. | 439/188 |
| 4,084,875 | 4/1978 | Yamamoto | 439/490 |
| 4,090,761 | 5/1978 | Souville et al. | 439/188 |
| 4,332,432 | 6/1982 | Colleran | 439/347 |
| 4,674,814 | 6/1987 | Hoshino et al. | 439/489 |

FOREIGN PATENT DOCUMENTS 51-69790 6/1976 Japan .

*Primary Examiner*—David Pirlot
*Attorney, Agent, or Firm*—Armstrong, Nikaido Marmelstein Kubovcik & Murray

[57] ABSTRACT

A connector with a connection check device which comprises male and female connector housings oppositely engaged, first and second slots so formed in the forward portions to be mated of both the connector housings as to be mated in a direction perpendicular to the engaging direction thereof at the time of engaging, a connection check conductor provided at one of the connector housings, a check contactor to be connected to the conductive portion of the connection check conductor and so provided as to be exposed through the first slot, and a spacer having a conductive portion to be engaged within both the slots when the first and second slots are registered to shortcircuit the check terminals by the engagement of the spacer. Thus, the check device can be readily attached to the connector.

4 Claims, 4 Drawing Sheets

CONNECTOR WITH CONNECTION CHECK DEVICE

BACKGROUND OF THE INVENTION

1. FIELD OF THE INVENTION

This invention relates to a connector with a device for confirming an electric connection.

2. DESCRIPTION OF THE PRIOR ART

When male and female connector housings are engaged to be electrically connected, the visual confirmation of whether or not male and female terminal members provided in a connector housing are positively connected is impossible from outside due to housing walls.

A connector disclosed in Japanese Utility Model Laid-open No. 51-69790 shown in FIG. 9 is known to solve this problem. In FIG. 9, reference numeral 1 denotes a male connector housing provided therein with a female terminal member 8, and numeral 2 denotes a female connector housing provided therein with a male terminal member 7. Conductors 3 and 4 are respectively connected to the female and male terminal members 7 and 8 for connecting electric components to a power source. Check conductors 5 and 5' are respectively provided in the connector housings 1 and 2, and check contactors 5*a* and 5*a*' respectively connected to the ends of the conductors 5 and 5' are so composed as to contact with each other only when the female and male terminal members 7 and 8 are completely connected. When the check conductors 5 and 5' are connected to a connection confirming device, whether or not the connection is complete can be confirmed.

However, according to the above-mentioned prior art, the check conductors 5 and 5' of the connection confirming devices must be connected to both the check conductors 5 and 5' provided in both the female and male connector housings. Therefore, in order to connect the check devices, the female and male connector housings must be formed the same, and have such drawbacks that are feasibly restricted in connecting timings and positions and might become frequently difficult to connect.

SUMMARY OF THE INVENTION

An object of this invention is to provide a connector with a connection confirming device which can eliminate the above-mentioned disadvantages of the prior art and in which the confirming device can be readily attached.

In order to achieve this and other objects, there is provided according to the present invention a connector with a connection check structure comprising first and second connector housings to be engaged with each other at respective forward portions thereof, said respective forward portions being formed with lateral slots adapted to be in registration at the time of full engagement:

at least two connection check conductors housed in one of said first and second connector housings to be exposed externally of said engaging connector housings through said slots:

a spacer adapted to be inserted into said slots from outside; and conductive short circuit means provided between said at least two connection check conductors and said spacer within said slots, said conductive short circuit means straddling said at least two connection check conductors.

Other and further objects, features and advantages of the invention will appear more fully from the following description.

DETAILED DESCRIPTION OF THE PREFERRED EMBODIMENTS

An embodiment of the present invention will be described in detail with reference to FIGS. 1 to 8. A female terminal member is contained in one connector housing, and a male terminal member is contained in the other connector housing, though not shown, in the connector housings as shown.

Figure 1:
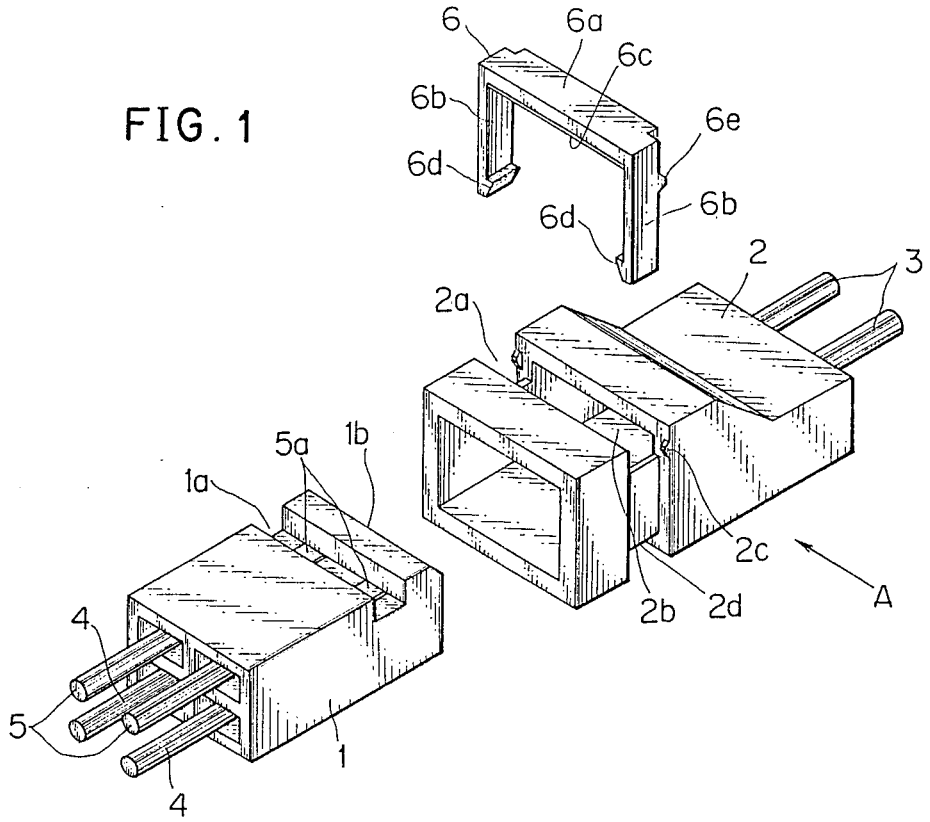
FIG. 1 is an exploded perspective view of male and female connector housings showing an embodiment of the present invention.

FIG. 1 is an exploded perspective view showing an embodiment of the present invention. In FIG. 1, reference numeral 1 denotes a male connector housing, numeral 2 denotes a female connector housing, numerals 3 and 4 denote conductors, numeral 5 and 5 denote a pair of connection check conductors, and numeral 6 denotes a spacer. An oblique surface 1*b* is so formed at the end of the male connector housing 1 at the engaging side as to be easily engaged, a first slot 1*a* is formed substantially perpendicularly to the engaging direction of the connector housing 1 at a forward portion thereof, and check contactors 5*a* and 5*a* to be connected to the conductive portions of the connection check conductors 5 and 5 are exposed externally of said housing through said slot 1*a*. On the other hand, a second slot 2*a* is formed on the outer periphery of the female connector housing 2 at a forward portion thereof, and an opening 2*b* to be mated with the first slot 1*a* of the connector housing 1 at the time of engaging is formed on the top thereof. A connecting protrusion 2*c* to be engaged with the connecting protrusion 6*e* of the spacer 6 to be described later is formed above the slot 2*a* of the connector housing 2.

Figure 2:
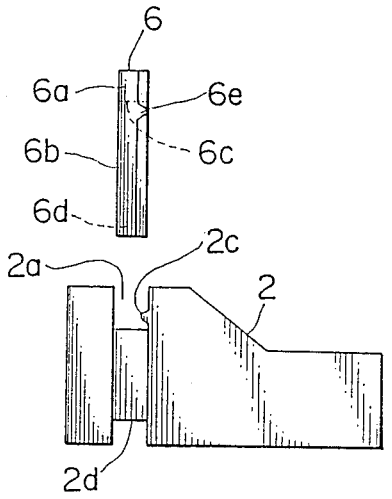
FIG. 2 is a view showing the female connector housing and a spacer as seen from an arrow A of FIG. 1.

FIG. 2 is a view showing the female connector housing 2 and the spacer 6 of FIG. 1 as seen from a direction of an arrow A of FIG. 1.

The spacer 6 is formed in a U shape as a whole, and temporarily connecting leg portions 6b and 6b are formed at both sides of a pressing portion 6a made at the center. A conductive portion 6c which straddles the connection check conductors 5 and 5 for shortcircuiting the check contactors 5a and 5a thereof is formed under the pressing portion 6a. The above-described protrusions 6e are formed near the roots of both the connecting leg portions 6b of the spacer 6, and temporarily connecting pawls 6d are formed at the ends of both the temporarily connecting leg portions 6b.

Figure 3:
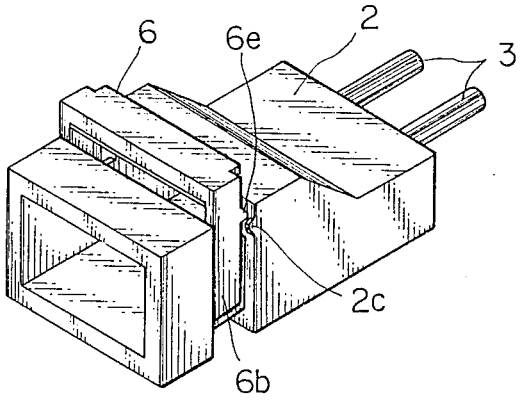
FIG. 3 is a perspective view showing the state that the spacer is temporarily engaged with the female connector housing.

FIG. 3 shows the state of the female connector housing before both the male and female connector housings are engaged. The connecting protrusions 6e of the spacer 6 ride on the connecting protrusions 2c of the second slot, and temporarily connected to the female connector housing 2 in the state that the pawls 6d at the ends of the temporarily connecting leg portions 6b are connected to the lower ends 2d of the second slot 2a (see FIG. 1).

In the embodiment described above, the spacer 6 is temporarily connected in advance. However, the invention is not limited to the particular embodiment. The spacer 6 may not be temporarily connected.

Figure 4:
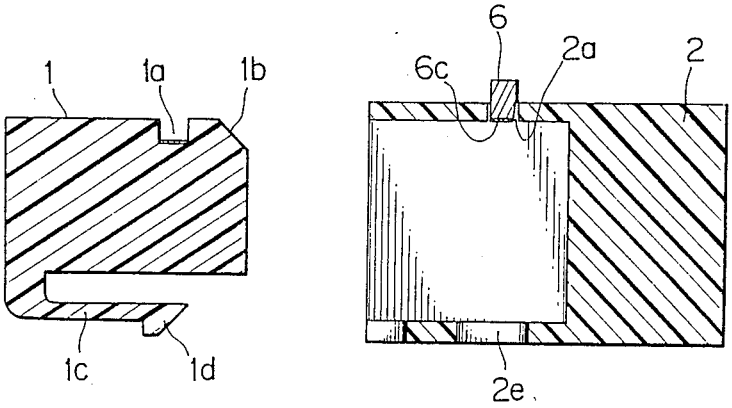
FIG. 4 is a sectional view showing the state before the male and female connector housings are engaged.

FIG. 4 is a view showing the state that the male and female connector housings 1 and 2 are separated. A locking arm 1c is formed on the lower surface of the male connector housing 1, and a connecting protrusion 1d is formed at the end of the locking arm 1c. On the other hand, a connecting hole 2e to be engaged with the protrusion 1d at the end of the locking arm 1c is formed at the female connector housing 2.

Figure 5:
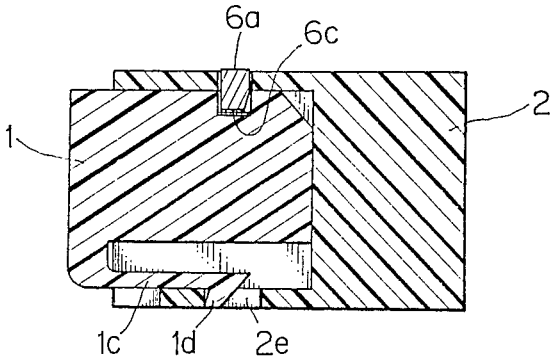
FIG. 5 is a sectional view showing the state when the engagement of the male and female connector housings are completed.

As shown in FIG. 5, when the male and female connector housing 1 and 2 are engaged, the connecting protrusion 1d at the end of the locking arm 1c is engaged within the connecting hole 2e, inner male and female terminal members (not shown) are engaged, and the opening of the second slot 2a is brought into registration with the first slot 1a the full engagement of the connector housings. When both the slots are registered, the pressing portion 6a is pressed from the state in FIG. 3 to engage the spacer 6 into both the slots. When the pressing portion 6a is pressed, the connecting protrusions 6e are connected over the protrusions 2c of the slot 2a, and the spacer 6 is fastened to the connector housing body. When the spacer 6 is thus fastened, the conductive portion 6c formed at the pressing portion 6a is contacted under pressure with the check contactors 5a and 5a.

Figure 6:
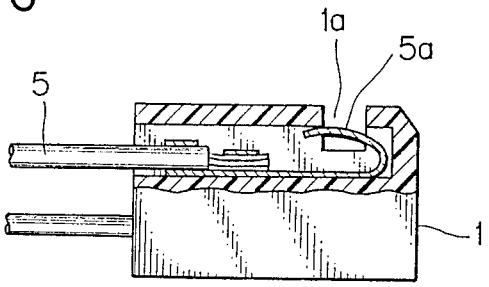
FIG. 6 is a partial fragmentarily sectional view showing the construction of a connection check conductor and a contactor.

FIG. 6 is a partial fragmentarily sectional view showing the connecting state of the check conductor 5 with the check contactors 5a. In FIG. 6, the conductive portion of the conductor 5 is press-connected to the contactor 5a. The contactor 5a is formed of a thin metal plate which has a high elasticity, made of brass or the like, and bent at a free end thereof in a U shape beneath the slot 1a to be easily contacted under pressure with the conductive portion 6c of the spacer 6. When the conductive portion 6c of the spacer 6 is contacted under pressure, the contactors 5a and 5a are shortcircuited to connect the check conductors 5 and 5.

The check conductors 5 and 5 are connected to a confirming device such as, for example, a warning buzzer or a lamp or the like. Thus, the lamp is turned ON at the time of completing the engagement of the connector housings, and when the engagement becomes incomplete due to the slack of the connector housings after the engagement, the warning buzzer will ring. Thus, the confirming device can be utilized at the time of not only engaging but monitoring after the engagement. Since the confirming device can be connected only with the male connector housing at any time, the range of attaching timing and position is increased.

In the embodiment described above, the second slot 2a is formed on the whole periphery of the female connector housing 2. However, the opening 2b is formed to be mated with the first slot 1a to merely contact with the contactors 5a and 5a. Therefore, the second slot 2a may be formed only on the upper side of the connector housing in FIG. 1.

Further, when the end of the spacer 6 in the engaging direction is so tapered as to be slightly convergent, the end of the spacer may be inserted slightly before the male and female connector housings 1 and 1 are completely engaged, and the spacer 6 is then pressed to accelerate the engagement of both the connector housings, thereby completely engaging easily them.

Figure 7:
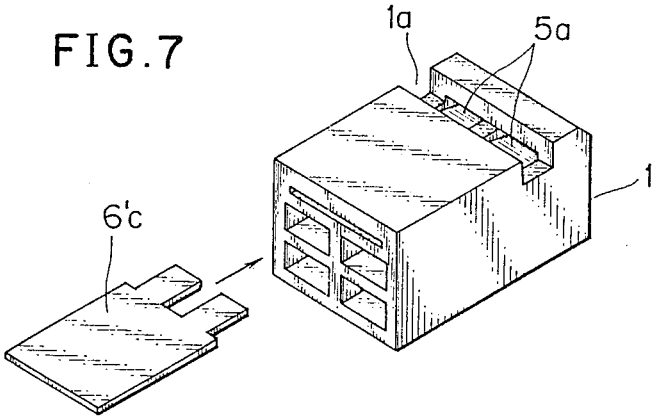
FIG. 7 is an exploded perspective view of the male connector housing and a conductive plate of another embodiment of the invention.
Figure 8:
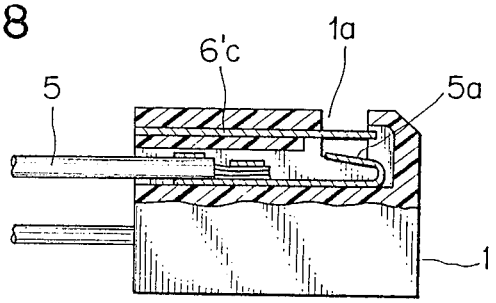
FIG. 8 is a partial fragmentarily sectional view showing the construction of a contactor and a conductive plate of the state that the conductive plate of FIG. 7 is inserted.
Figure 9:
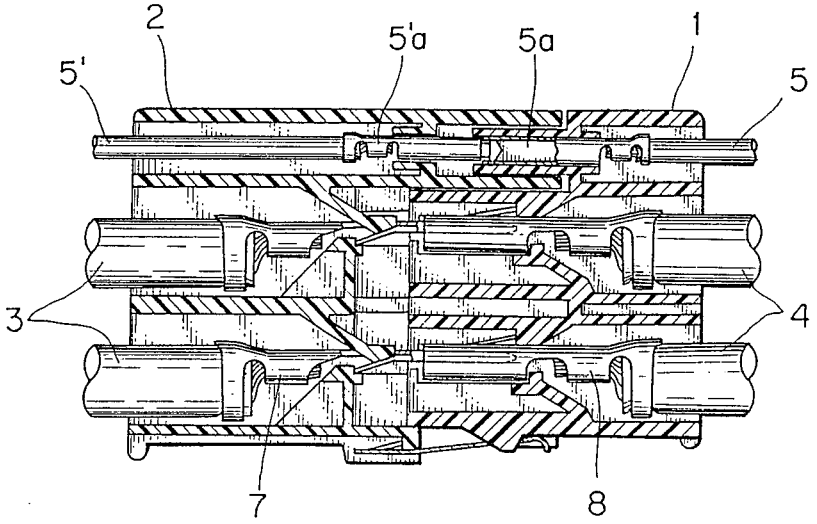
FIG. 9 PRIOR ART
FIG. 9 is a sectional view showing a prior art connector.

FIG. 7 shows another embodiment of the invention. A conductive plate 6'c is provided at the upper portion of the contactor to contact under pressure the contactors 5a and 5a with the conductive plate 6'c when the spacer 6 is inserted into the connector housing 1 so as to shortcircuit the contactors 5a and 5a. FIG. 8 shows the state that the conductive plate 6'c in the embodiment in FIG. 7 is inserted into the male connector housing 1.

According to the present invention, the first and second slots are formed to be mated at the engaging time of the male and female connector housings on the forward portions to be mated of both the connector housings, the check contactor connected to the conductive portion of the connection check conductor provided in one connector housing is provided to be exposed externally of the housing through the first slot, the spacer formed with the conductive portion to be engaged with both the slots when the slots at the time of completing the engagement of both the connector housings are mated is provided, and the check terminals are shortcircuited by the insertion of the spacer. Therefore, whether or not the male and female connector housings are completely engaged can be confirmed, and a connection confirming device can be connected in advance to one connector housing, thereby easily connecting it to the confirming device.

What is claimed is:

1. A connector with a connection check structure comprising first and second connector housings to be engaged with each other at respective forward portions thereof, said respective forward portions being formed with lateral slots adapted to be in registration at the time of full engagement:

at least two connection check conductors housed in one of said first and second connector housings to be exposed externally of said engaging connector housings through said slots:

a spacer adapted to be inserted into said slots from outside said connector housings; and conductive short circuit means provided between said at least two connection check conductors and said spacer within said slots, said conductive short circuit means straddling said at least two connection check conductors.

2. A connector with a connection check structure according to claim 1, wherein said conductive short circuit means includes a conductive portion formed in said spacer, said conductive portion being pressed against said at least two connection check conductors at the time of spacer insertion.

3. A connector with a connection check structure according to claim 1, wherein said conductive short circuit means includes a conductive plate supported in said one of the housings to extend into said slots, and be pressed against said at least two connection check conductors at the time of spacer insertion.

4. A connector with a connection check structure according to claim 2 or 3, wherein said at least two connection check conductors has free ends thereof bent beneath the slot of the said one of the connector housings.

* * * * *